United States Patent [19]

Beyl

[11] 4,141,571

[45] Feb. 27, 1979

[54] HEEL HOLD-DOWN PIVOT PLATE FOR SKI BINDING

[76] Inventor: Jean J. A. Beyl, Boulevard Victor-Hugo, Nevers, Nievre, France

[21] Appl. No.: 831,242

[22] Filed: Sep. 7, 1977

[30] Foreign Application Priority Data

Sep. 28, 1976 [FR] France ..... 76 29075

[51] Int. Cl.[2] ..... A63C 9/00

[52] U.S. Cl. ..... 280/620; 280/636

[58] Field of Search ..... 280/620, 618, 636, 617, 280/633, 634, 611, 607; 36/117

[56] References Cited

U.S. PATENT DOCUMENTS

| | | | |
|---|---|---|---|
| 3,145,027 | 8/1964 | Berchtold et al. | 280/620 X |
| 3,172,678 | 3/1965 | Beyl | 280/620 |
| 3,210,090 | 10/1965 | Keeling et al. | 280/620 |
| 4,077,653 | 3/1978 | Beyl | 280/618 X |

*Primary Examiner*—Joseph F. Peters, Jr.
*Assistant Examiner*—Milton L. Smith
*Attorney, Agent, or Firm*—Bierman & Bierman

[57] ABSTRACT

A rotary plate for a heel hold-down device of a ski binding has a central opening formed with a notch or projection along its edge and adapted in its normal angular position to engage a corresponding projection or notch, respectively formed in a fixed member; a spring means constituting with the notch and projection a detent-positioning device constantly urges the rotary plate in the longitudinal direction within the limits of a predetermined play.

3 Claims, 6 Drawing Figures

HEEL HOLD-DOWN PIVOT PLATE FOR SKI BINDING

BACKGROUND OF THE INVENTION

1. Field of the Invention

The present invention relates to a fastening device intended for retaining the heel of a ski boot on a ski. For this purpose, it comprises a plate adapted to be engaged by the heel of the ski boot, said plate being rotatably mounted about a mounting member rigid with the ski, and provided with means for retaining the rear portion of the ski boot.

However, this device is designed with a view to prevent ski flexions occurring when skiing between bumps, from compressing the boot sole between the toe-end binding device engaging the toe end of the sole and the heel hold-down means provided on said rotary plate. For this purpose, the rotary plate is mounted on the mounting plate rigid with the ski with a certain longitudinal lost motion, a spring being interposed between these two components. Thus, in case of ski flexion, the rotary plate supporting the boot heel can move somewhat in the longitudinal direction. However, under normal skiing conditions the boot is safely maintained between the toe device and the heel hold-down means carried by the rotary plate. In fact, the rotary plate is constantly urged forwardly by the return spring interposed between the rotary plate and the mounting plate rigid with the ski.

When positioning the boot heel on the rotary plate of the device according to this invention, this rotary plate should preferably be kept in its normal skiing position, so that the heel retaining means is disposed at the rear. For this purpose, a lock bolt adapted to be operated manually may be provided for holding the rotary plate against movement in its normal position. However, this lock bolt should subsequently be restored to a retracted or inoperative position to permit the free rotational movements of the rotary plate. This movement of the lock bolt to its retracted position may be controlled if desired by the means provided for retaining the heel on the plate when the heel is brought to its proper or skiing position thereon. This solution involves a special arrangement of said means. Besides, before engaging the boot in position, the user must actuate the lock bolt after having brought the rotary plate to its normal position.

2. Description of the Invention

It is the essential object of this invention to provide conditions such as to keep initially the rotary plate in this normal position without resorting to a lock bolt to be actuated manually by the user. For this purpose, there is provided between the rotary plate and the mounting member rigid with the ski a detent positioning device capable of holding the rotary plate in its normal angular position, the arrangement being such that this detent-positioning device is rendered inoperative when said plate is moved to the rear against the force of a return spring.

Now, this backward movement takes place automatically when positioning the boot since, to perfectly hold the boot against movement on the ski, a light pressure must be exerted between the toe device and the heel hold-down device of the ski binding. Thus, the detent positioning device is rendered automatically inoperative to permit the free pivotal movement of the rotary plate.

Other features and adavantages of the device according to this invention will appear as the following description proceeds with reference to the attached drawing given by way of illustration, not of limitation.

DESCRIPTION OF THE PREFERRED EMBODIMENTS

Figure 1:
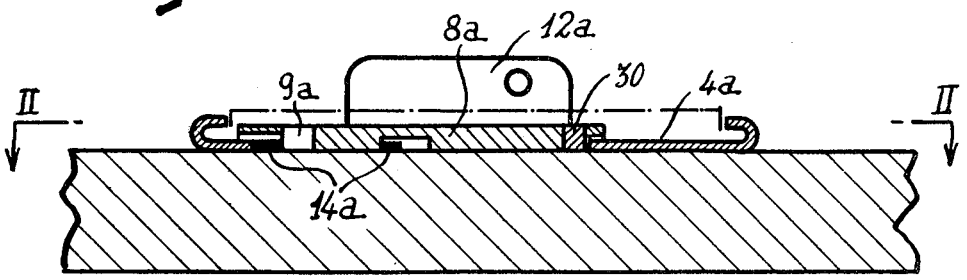
FIG. 1 is a longitudinal section showing the heel hold-down device of this invention, before engaging the boot thereon.

The device illustrated in FIGS. 1–4 of the drawing comprises a rotary plate 4a having a circular aperture 7a formed therein which surrounds a mounting member 8a secured to the ski by means of screws 9a. This mounting member 8a constitutes a fixed pivot member about which the plate 4a can pivot. This rotary plate 4a carries on its lateral sides upstanding lips or ears 12a adapted to hold the heel portion of the ski boot in the transverse direction. Moreover, these lips or ears may be used for supporting a heel hold-down device proper.

Figure 2:
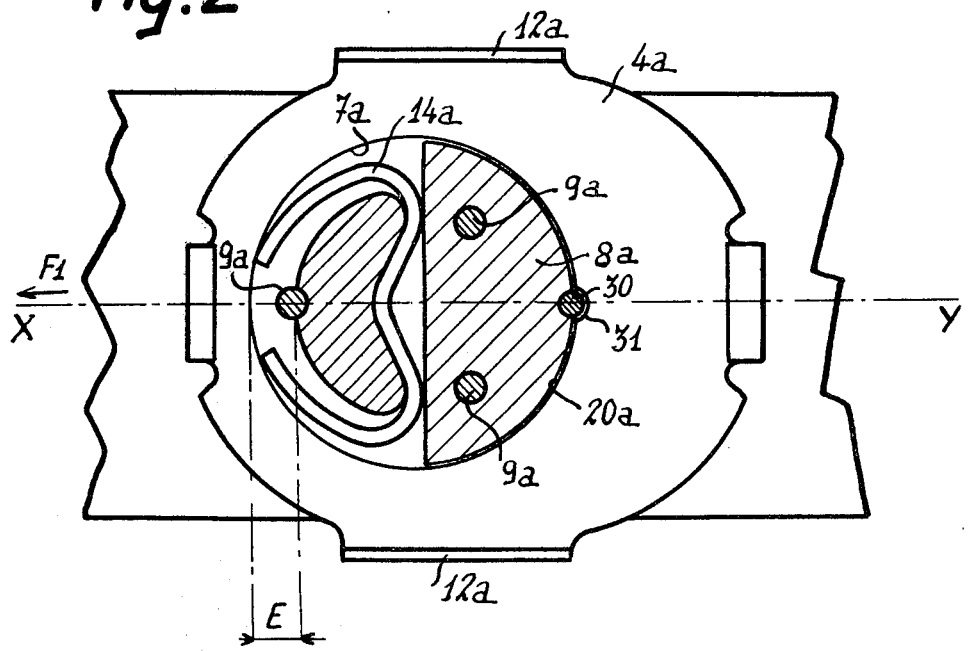
FIG. 2 is a horizontal section taken along the line II—II of FIG. 1.

As clearly shown notably in FIG. 2, the pivot-forming mounting member 8a occupies only one fraction of the surface area of aperture 7a to permit a certain free motion E of pivot plate 4a in the longitudinal direction of the ski. Besides, the fixed pivot member 8a comprises on its rear side, i.e. towards the heel end of the ski, a substantially semi-circular portion 20a adapted to co-act with the circular edge of aperture 7a for acting as a pivot means for the plate 4a during the rotation thereof.

A resilient means is interposed between the front end of pivot plate 8a and the front portion of the edge of aperture 7a of pivot plate 4a. This resilient means will thus constantly urge this plate 4a in the forward direction, as shown by the arrow $F_1$, thus normally holding the rear portion of the edge of aperture 7a in contact with the circular rear portion 20a of pivot member 8a. However, this resilient means permits the backward movement of the pivot plate within the limits set by the play E.

The resilient means thus provided consists preferably of a resilient or spring blade 14a having a loop configuration, the intermediate portion of the loop being secured to pivot member 8a while its curved lateral arms resiliently engage at the front the front portion of the aperture 7a in pivot plate 4a.

According to this invention, there is provided between the fixed pivot 8a and the rotary plate 4a a detent-positioning device capable of holding this plate 4a against movement in its normal angular position. In the example illustrated, this system comprises a projection 30 having a circular cross-section, carried by the rear circular portion 20a of pivot member 8a, and a corresponding notch 31 formed in the rear portion of the aperture 7*a* of said pivot plate. This projection 30 may consist of a metal stud forming an insert at the rear of pivot member 8*a*. However, this projection may also consist of a boss formed integrally with the pivot member proper, and obtained during the manufacture of this member by stamping, cutting or any other suitable method. Possibly, the arrangement of projection 30 and corresponding notch 31 may be inverted, and in this case the notch is formed in pivot member 8*a* and the projection on the corresponding portion of the aperture 7*a* of the rotary plate.

The projection 30 rigid with the fixed pivot member 8*a* lies on the longitudinal axis XY of the device. This also applies to the position of notch 31 of the rotary plate when the latter is in its normal angular position. Consequently, in this position the projection 30 engages the notch 31 since the force of spring 14*a* tends to move the rotary plate forwards and to keep the rear portion of aperture 7*a* in contact with the rear circular portion 20*a* of the fixed pivot member. As a result, the rotary plate 4*a* is held in its normal angular position shown in FIG. 2, and thus the user can easily engage the heel of his ski boot on the rotary plate and cause this heel to be retained thereon by means of the device provided for this purpose (not shown), such as a heel hold down device of a ski binding.

Figure 3:
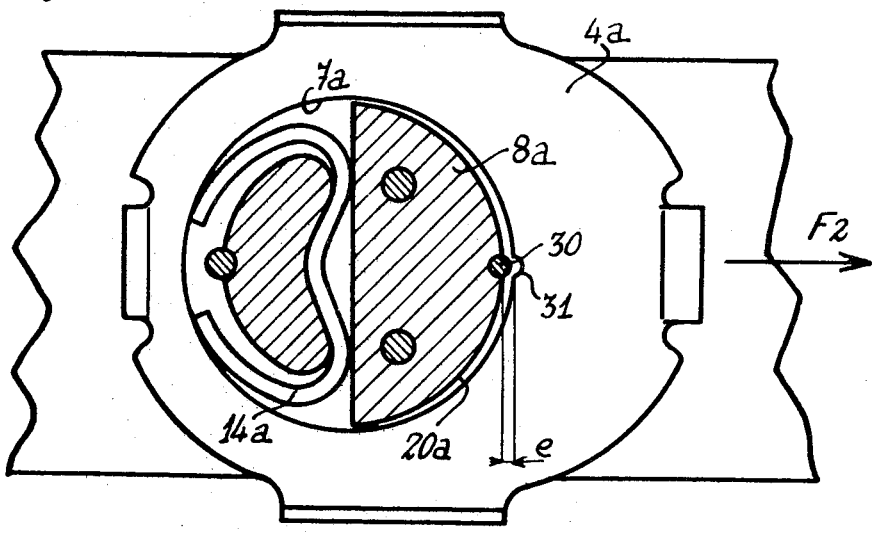
FIG. 3 is a similar view showing the same device after engaging the heel of a ski boot thereon and causing a partial backward movement of the rotary plate.

However, fitting the boot in position will cause automatically a slight backward movement of rotary plate 4*a* to the position shown in FIG. 3. This is due to the fact that, in order perfectly to lock the boot on the ski, the retaining means provided at the rear are so arranged and adjusted that they exert a slight forward pressure on the boot. Therefore, when the boot is properly positioned on the device, it actually causes the rotary plate 4*a* to recede slightly in the direction of the arrow $F_2$.

Now, this backward movement is sufficient for releasing the notch 31 from the projection 30 of the fixed pivot member. Therefore, at the same time the rotary plate 4*a* can rotate freely. The provision of a detent positioning device between this plate 4*a* and the fixed pivot will not interfere in any way with the operation of the present device.

Figure 4:
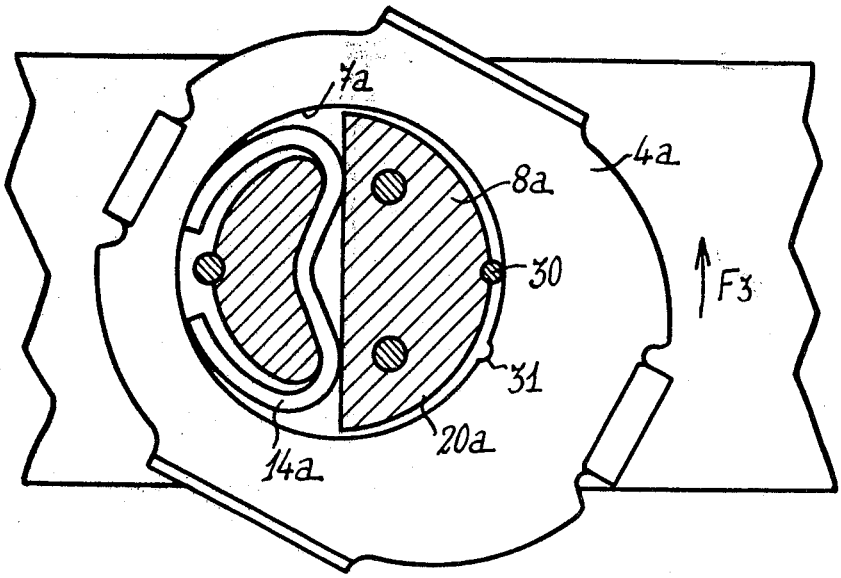
FIG. 4 is a similar view showing this plate after its rotation.

If, after a voluntary or accidental release of the boot heel, the rotary plate 4*a* happens to assume a position other than the normal position defined hereinabove, for example the angular position shown in FIG. 4, it is only necessary for the skier to cause this plate to rotate in the direction of the arrow $F_3$ until the notch 31 registers with the fixed projection 30. Besides, the rotary movement of plate 4*a* is stopped immediately when this registration occurs. Thus, the plate is held automatically in its normal angular position, and the ski boot can again be restored very easily to its proper position.

From the foregoing it appears clearly that with this detent-positioning device it is unnecessary to provide an external lock bolt for holding the rotary plate against motion. Now, this detent-positioning device does not increase the over-all dimensions of the assembly and its cost is extremely low. Of course, the main advantage characterizing this detent-positioning device lies in the fact that it does not create any additional source of frictional contact during the normal rotation of the rotary plate 4*a*, since in this case the detent-positioning device is completely inoperative.

Besides, it may be emphasized that even in the locking position illustrated in FIG. 2 the coupling provided by this detent-positioning device is not rigid. In fact, the projection 30 is caused to escape quite naturally from its companion notch 31 when the rotary plate is rotated on purpose, the rotary plate receding only slightly in this case. However, if desired another retaining force of any desired and suitable value may be obtained by modifying accordingly the dimensions of projection 30 and notch 31.

Figure 5:
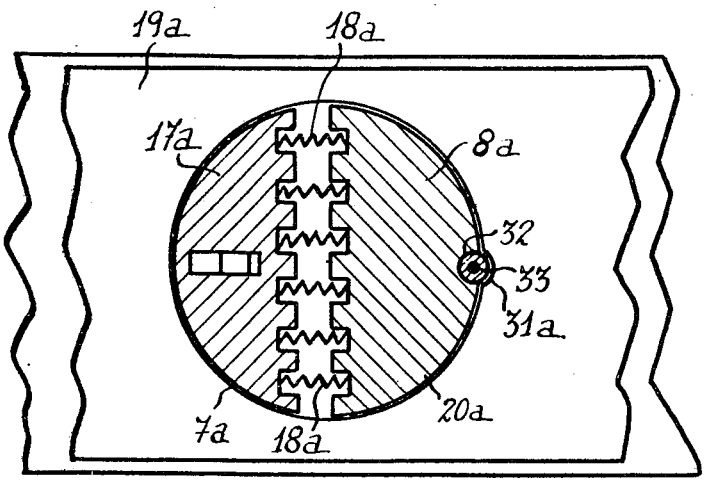
FIG. 5 is a horizontal section showing another form of embodiment of the device of this invention, shown before fitting the boot heel in position.

Of course, this device should not be construed as being strictly limited to the single form of embodiment described hereinabove. Thus, FIGS. 5 and 6 of the drawing illustrate another form of embodiment in which the resilient means urging the corresponding rotary plate 19*a* forwardly consists of a small plate 17*a* having the shape of a segment of a circle; this plate 17*a* is movable in the longitudinal direction and formed at its front edge with a circular contour engaging the front portion of aperture 7*a* of rotary plate 19*a*. In fact, the small movable plate 17*a* reacts against the fixed pivot member 8*a* through a set of small coil compression springs 18*a*.

As in the preceding form of embodiment, there is provided in this modified structure a detent-positioning device disposed between the pivot member 8*a* and the rotary plate 19*a*. In the present case the projection of this detent-positioning device consists of a roller 32 mounted for rotation about a fixed pin 33 and projecting from the circular rear portion 20*a* of fixed pivot member 8*a*. Registering therewith is the notch 31*a* formed in the rear portion of the aperture 7*a* of rotary plate 19*a*.

Figure 6:
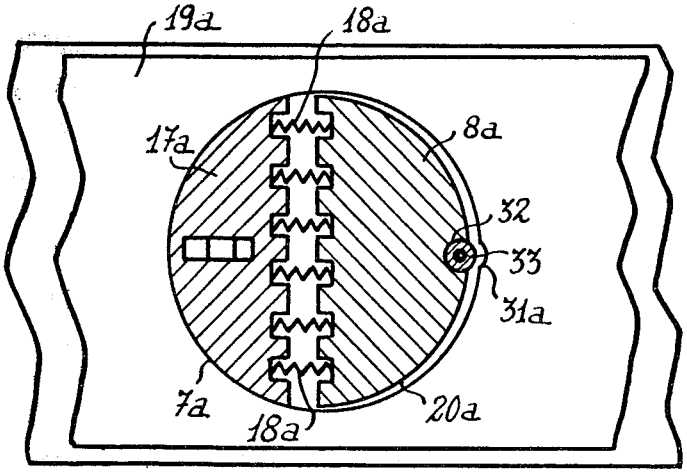
FIG. 6 is a similar view showing the same device after a partial backward movement of the rotary plate when fitting the boot heel in position.

In this example, the detent-positioning device operates as in the preceding case. In fact, as illustrated in FIG. 6, this detent-positioning device is rendered inoperative when the rotary plate 19*a* recedes slightly when fitting the ski boot in position thereon.

Of course, many other modifications and changes may be brought to the device shown and illustrated herein without departing from the basic principles of the invention as described in the attached claims. Besides, the component elements of the detent-positioning device may be constructed in various manners without departing from the spirit and scope of the invention.

As already mentioned in the foregoing, this device is intended for supporting the heel of a ski boot, the toe end of the boot being retained by a another device of any suitable type. However, the rotary plate of the present device may either act as a simple support to the heel of the ski boot, as in the example illustrated in FIGS. 1 to 4, or be converted into a plate of larger size, capable of supporting the complete boot; in this last instance, the rotary plate is provided with binding means adapted to retain both the heel and the toe end of the ski boot.

What I claim is:

1. A device for fixing the heel of a ski boot to a ski, comprising a mounting member rigidly attached to said ski, a plate adapted to be engaged by the heel of said boot, said plate having an aperture for rotatably and slidably positioning said plate on said mounting member, spring means on said mounting member urging said plate toward the front of the ski, while permitting rearward displacement thereof, and detent means intermediate one side of said aperture and said mounting member for releasably positioning said plate on said mounting member in a desired angular position.

2. A device according to claim 1, in which said detent means includes a projection extending outwardly from said mounting member and in which said plate is provided with a notch adapted to be engaged by said projection under the action of said spring means, both said projection and said notch being positioned in said device toward the rear of said ski, whereby when said plate is moved rearwardly of said ski, said projection and notch become disengaged and permit rotation of said plate relative to said mounting member.

3. A device according to claim 1, in which said detent means includes a projection extending inwardly from said plate and in which said mounting member is provided with a notch adapted to be engaged by said projection under the action of said spring means, both said projection and said notch being positioned in the said device toward the rear of said ski, whereby when said plate is moved rearwardly of said ski, said projection and notch become disengaged and permit rotation of said plate relative to said mounting member.

* * * * *